US011211714B2

(12) United States Patent
Goh et al.

(10) Patent No.: US 11,211,714 B2
(45) Date of Patent: Dec. 28, 2021

(54) SLOT ANTENNA ON A PRINTED CIRCUIT BOARD (PCB)

(71) Applicant: Intel Corporation, Santa Clara, CA (US)

(72) Inventors: Eng Huat Goh, Ayer Itam (MY); Min Suet Lim, Gelugor (MY); Boon Ping Koh, Seberang Jaya (MY); Wil Choon Song, Bayan Lepas (MY); Khang Choong Yong, Puchong (MY)

(73) Assignee: Intel Corporation, Santa Clara, CA (US)

( * ) Notice: Subject to any disclaimer, the term of this patent is extended or adjusted under 35 U.S.C. 154(b) by 40 days.

(21) Appl. No.: 16/462,516

(22) PCT Filed: Nov. 21, 2017

(86) PCT No.: PCT/US2017/062759
§ 371 (c)(1),
(2) Date: May 20, 2019

(87) PCT Pub. No.: WO2018/118321
PCT Pub. Date: Jun. 28, 2018

(65) Prior Publication Data

US 2019/0348766 A1 Nov. 14, 2019

(30) Foreign Application Priority Data

Dec. 21, 2016 (MY) ..... PI 2016704738

(51) Int. Cl.
*H01Q 13/18* (2006.01)
*H01Q 1/38* (2006.01)
(Continued)

(52) U.S. Cl.
CPC ..... *H01Q 13/18* (2013.01); *H01Q 1/38* (2013.01)

(58) Field of Classification Search
CPC ..... H01Q 1/38; H01Q 1/2283; H01Q 1/48; H01Q 21/28; H01Q 9/0407; H01Q 21/24;
(Continued)

(56) References Cited

U.S. PATENT DOCUMENTS

2006/0017157 A1* 1/2006 Yamamoto ..... H05K 1/0243 257/728
2008/0291115 A1* 11/2008 Doan ..... H01Q 21/0087 343/893
(Continued)

OTHER PUBLICATIONS

International Search Report and Written Opinion dated Mar. 12, 2018 for International Patent Application No. PCT/US2017/062759, 10 pages.

*Primary Examiner* — Wei (Victor) Y Chan
(74) *Attorney, Agent, or Firm* — Schwabe, Williamson & Wyatt, P.C.

(57) ABSTRACT

Embodiments herein disclose techniques for apparatuses and methods for making a slot antenna on a PCB with a cutout. A PCB may include a metal layer. The metal layer may include a cavity to be a first radiating element of an antenna, and a slot to be a second radiating element of the antenna. In addition, the cavity may extend to be the cutout of the PCB through other layers of the PCB. The first and second radiating elements may provide a determined transmission frequency for the antenna. The metal layer may further include a portion of a transmission line of the antenna, and the transmission line is in contact with the cavity and the slot. A package may be affixed to the PCB, where a portion of the package may be within the cutout of the PCB. Other embodiments may be described and/or claimed.

4 Claims, 7 Drawing Sheets

(51) Int. Cl.
*H01Q 1/48* (2006.01)
*H01Q 21/28* (2006.01)

(58) Field of Classification Search
CPC ..... H01Q 21/065; H01Q 1/243; H01Q 1/50; H01Q 21/064; H01Q 9/0414
USPC ..... 343/700 MS, 767, 770, 702, 795
See application file for complete search history.

(56) References Cited

U.S. PATENT DOCUMENTS

| | | | | |
|---|---|---|---|---|
| 2011/0291901 | A1* | 12/2011 | DeJean | H01Q 1/38 343/770 |
| 2013/0313692 | A1 | 11/2013 | Soler Castany et al. | |
| 2014/0145883 | A1 | 5/2014 | Baks et al. | |
| 2015/0084830 | A1 | 3/2015 | Elsherbini et al. | |
| 2016/0164186 | A1* | 6/2016 | Ganchrow | H01Q 13/18 343/702 |
| 2016/0204514 | A1* | 7/2016 | Miraftab | H01Q 21/005 343/737 |

* cited by examiner

SLOT ANTENNA ON A PRINTED CIRCUIT BOARD (PCB)

CROSS REFERENCE TO RELATED APPLICATIONS

The present application is a national phase entry under 35 U.S.C. § 371 of International Application No. PCT/US2017/062759, filed Nov. 21, 2017, entitled "SLOT ANTENNA ON A PRINTED CIRCUIT BOARD (PCB)", which claims priority to Malaysian Application PI 2016704738, filed Dec. 21, 2016, entitled "SLOT ANTENNA ON A PRINTED CIRCUIT BOARD (PCB)." PCT/US2017/062759 designated, among the various States, the United States of America. The Specification of the PCT/US2017/062759 Application is hereby incorporated by reference.

RELATED APPLICATION

The present application claims priority to Malaysian Patent Application No. PI 2016704738, entitled "SLOT ANTENNA ON A PRINTED CIRCUIT BOARD (PCB)," filed Dec. 21, 2016.

TECHNICAL FIELD

The present disclosure relates to the field of electronic circuits. More particularly, the present disclosure relates to slot antennas on a printed circuit board (PCB).

BACKGROUND

The background description provided herein is for the purpose of generally presenting the context of the disclosure. Unless otherwise indicated herein, the materials described in this section are not prior art to the claims in this application and are not admitted to be prior art by inclusion in this section.

Electronic components, e.g., integrated circuit (IC) chips or dies, may be placed into protective IC packages to allow easy handling and assembly onto printed circuit boards (PCB) and to protect the electronic components from damage. Components within a package may have different heights. For example, a package may have some tall components and some low components, such as components within a central processing unit (CPU) package or a magnetic inductor array (MIA). To accommodate tall components in a package, a cutout may be made on the PCB so that the tall components of the package may be physically placed within the cutout, to reduce the overall height of the package on the PCB. The so formed cutout of the PCB may potentially cause electromagnetic interferences to the adjacent circuitries in the package. In practice, such cutouts may be covered with an electromagnetic shield which may add cost to the system.

BRIEF DESCRIPTION OF THE DRAWINGS

Embodiments will be readily understood by the following detailed description in conjunction with the accompanying drawings. To facilitate this description, like reference numerals designate like structural elements. Embodiments are illustrated by way of example, and not by way of limitation, in the figures of the accompanying drawings.

DETAILED DESCRIPTION

Figure 1:
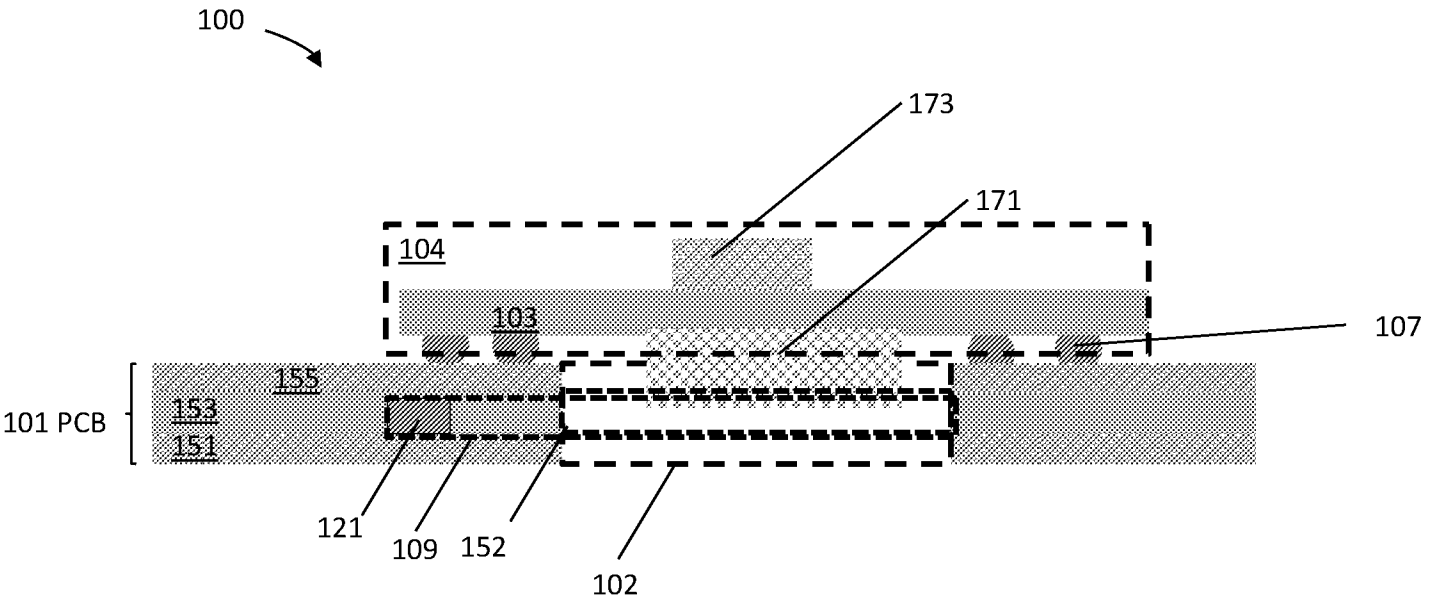
FIG. 1 illustrates a cross-section view of an example electronic apparatus including a PCB having a cutout, and a slot antenna formed in a metal layer of the PCB, according to various embodiments.

Embodiments of the present disclosure include techniques and configurations for apparatuses and methods for making a slot antenna in a metal layer of a PCB with a cutout, wherein the cutout may be provided to place a portion of a package within the cutout. In some embodiments, a PCB may include a metal layer. The metal layer may include a cavity to be a first radiating element of an antenna, and a slot to be a second radiating element of the antenna. In addition, the cavity may extend to be a cutout of the PCB that is through other layers of the PCB. The first and second radiating elements may provide a determined transmission frequency for the antenna. The metal layer may further include a portion of a transmission line of the antenna, and the transmission line may be in contact with the cavity and the slot.

In some embodiments, an electronic apparatus may include a PCB having a cutout, and a package affixed to the PCB, where a portion of the package may be within the cutout of the PCB. The PCB may include a metal layer, where the metal layer may have a cavity formed by the cutout through the metal layer, and the cavity may be a first radiating element of an antenna. In addition, the metal layer may have a slot, and the slot may be a second radiating element of the antenna. The first and second radiating elements may provide a determined transmission frequency for the antenna.

In some embodiments, a method for making a PCB may include: forming a cutout in a PCB, where the cutout may extend into a metal layer of the PCB to form a cavity in the metal layer; and forming a slot in the metal layer, wherein the cavity and the slot may provide first and second radiating elements of an antenna with a determined transmission frequency. In some embodiments, the method may further include forming a portion of a transmission line of the antenna in the metal layer, wherein the transmission line is in contact with the cavity and the slot in the metal layer.

In the following detailed description, reference is made to the accompanying drawings which form a part hereof wherein like numerals designate like parts throughout, and in which is shown by way of illustration embodiments that may be practiced. It is to be understood that other embodiments may be utilized and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that like elements disclosed below are indicated by like reference numbers in the drawings.

Various operations may be described as multiple actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The description may use the phrases "in an embodiment," or "in embodiments," which may each refer to one or more of the same or different embodiments. Furthermore, the terms "comprising," "including," "having," and the like, as used with respect to embodiments of the present disclosure, are synonymous.

The description may use the phrase "communicatively coupled." The phrase may mean that an electrical signal may propagate among the elements that are communicatively coupled.

As used herein, the term "circuitry" may refer to, be part of, or include an Application Specific Integrated Circuit (ASIC), an electronic circuit, a processor (shared, dedicated, or group) and/or memory (shared, dedicated, or group) that execute one or more software or firmware programs, a combinational logic circuit, and/or other suitable components that provide the described functionality.

FIG. 1 illustrates a cross-section view of an example electronic apparatus 100 including a PCB 101 having a cutout 102, and a slot antenna 109 formed in a metal layer 153, according to various embodiments. For clarity, features of an IC package, e.g., an IC package 104, or a PCB, e.g., the PCB 101, may be described below as examples for understanding an example IC package and/or an example PCB. It is to be understood that there may be more or fewer components within an IC package and/or a PCB. Further, it is to be understood that one or more of the components within the IC package and/or the PCB may include additional and/or varying features from the description below, and may include any device that one having ordinary skill in the art would consider and/or refer to as an IC package.

The PCB 101 may mechanically support and electrically connect electronic components, e.g., the package 104, using conductive tracks, pads and other features etched from copper sheets or other metal sheets laminated onto a non-conductive substrate. In embodiments, the PCB 101 may be a motherboard with expansion capability so that various components or packages may be attached to the PCB. For example, packages attached to the PCB 101 may include peripherals, interface cards, TV tuner cards, or cards providing extra USB or FireWire slots. The PCB 101 may also include daughter cards attached to the PCB 101, where the daughter cards may include sound cards, video cards, network cards, hard drives, or other forms of persistent storage, or a variety of other custom components or packages. In some embodiments, the PCB 101 may be a mainboard, which may be a single board with limited or no additional expansion capability, such as controlling boards in laser printers, televisions, washing machines, or other embedded systems with limited expansion abilities.

In embodiments, the PCB 101 may be a single sided board with one metal layer, a double sided board with two metal layers, or a multi-layer board with outer and inner layers. In embodiments, the PCB 101 may be a multi-layer board including a plurality of layers, such as a layer 151, a layer 153, and a layer 155. The plurality of layers may include a metal layer, a ground layer, a power layer, or a signal layer. For example, the layer 153 may be a metal layer. More details of a PCB and the plurality of layers may be shown in FIGS. 7-9. Conductors on different layers of the PCB 101 may be connected with vias.

The PCB 101 may have a cutout 102. In embodiment, the cutout 102 may extend through the plurality of layers. For example, the cutout 102 may extend through the layer 151, the layer 153, and the layer 155. In some other embodiments, a cutout may cut through a number of layers, but may leave some other layers intact, without cutting through all the layers of the PCB 101.

The cutout 102 may cut through a metal layer, e.g., the layer 153, and form a cavity 152 on the layer 153. The cavity 152 may radiate unintentionally, causing electromagnetic interference to the adjacent circuitries, e.g., a radio frequency (RF) circuitry within the package 104. Covering up such a cutout, e.g., the cutout 102, with an electromagnetic shield may reduce electromagnetic interference, but may add cost to the system. In embodiments, one or more additional slots, e.g., a slot 121, may be added to the metal layer, e.g., the layer 153, so that the additional slot 121 may function together with the cavity 152 to form a slot antenna 109, providing a determined transmission frequency for the antenna. More details of the one or more slots in a metal layer, e.g., the layer 153, may be shown in more details in FIGS. 2-3.

In embodiments, a package, e.g., the package 104, may be affixed to the PCB 101 by one or more connectors 107. In embodiments, the package 104 may be a chip scale package (CSP), a wafer-level package (WLP), a multi-chip package (MCP), a quad-flat no-leads (QFN) package, a dual-flat no-leads (DFN) package, a flip chip package, or a ball grid array (BGA) package. A CSP may be a flip chip device including solder balls or bumps that are approximately 250 um tall. A wafer-level package may be an IC package at a wafer level, instead of individual dies obtained from dicing them from a wafer. Both QFN and DFN packages may refer to packages that connect ICs to the surfaces of PCBs without through-holes.

In embodiments, the package 104 may include a substrate 103. In embodiments, the substrate 103 may be a polymeric substrate, a non-polymeric substrate, a silicon substrate, a silicon on insulator (SOI) substrate, or a silicon on sapphire (SOS) substrate, among various other substrate materials.

In embodiments, the package 104 may include a component 171 and/or a component 173 coupled to the substrate 103. In embodiments, the component 171 and/or the component 173 may include active devices, or passive devices such as capacitors, resistors. For example, the component 171 and/or the component 173 may be a chip for a processor, a memory chip, a radio frequency (RF) chip, or others. The components 171 and/or the component 173 may be placed on different sides of the substrate 103. In embodiments, a component of the package, e.g., the component 171, or a portion of the component, may be within the cutout, e.g., the cutout 102, of the PCB.

The package 104 may be coupled to the PCB 101 by the connector 107. One or more such connectors may be used to make the connection between the package 104 and the PCB 101. In embodiments, the connector 107 may be a stud, a wire-bonding wire, a bump, a ball, a solder pillar, or others. For example, the connector 107 may include one or more solder balls, where the solder balls may include solder alloy such as tin-lead (Sn—Pb) solders or lead free solders such as tin/silver/copper or some other lead-free solder.

In addition, the package 104 may include more materials or components not shown. For example, the package 104 may include an underfill layer between the component 171 and the substrate 103, or between the component 173 and the substrate 103.

Figure 2:
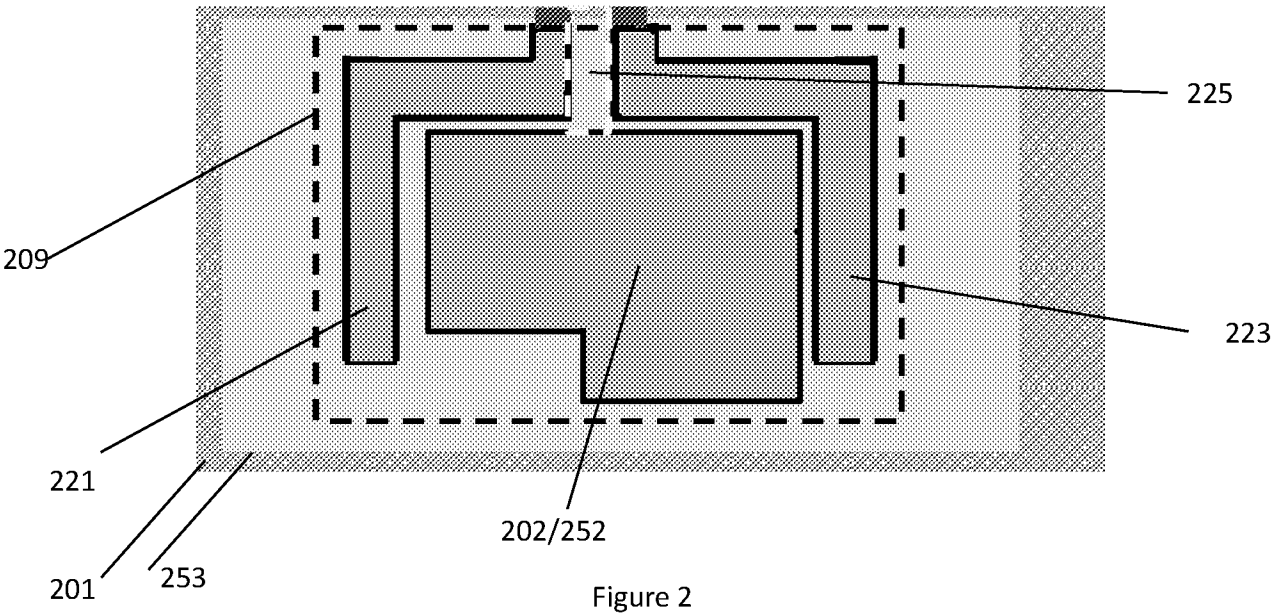
FIG. 2 illustrates a top view of an example PCB having a cutout, and a slot antenna formed in a metal layer of the PCB, according to various embodiments.

FIG. 2 illustrates a top view of an example PCB 201 having a cutout 202, and a slot antenna 209 formed in a metal layer 253 of the PCB 201, according to various embodiments. In embodiments, The PCB 201 may be an example of the PCB 101 shown in FIG. 1, where the metal layer 253 may be an example of the layer 153, and the cutout 202 may be an example of the cutout 102.

In embodiments, the metal layer 253 may include a cavity 252 formed in the metal layer 253 by the cutout 202 of the PCB 201. As shown in top view, the cutout 202 and the cavity 252 in the metal layer 253 may look the same. The cavity 252 may be a first radiating element of the slot antenna 209.

In embodiments, the metal layer 253 may further include a slot 221, where the slot 221 may be a second radiating element of the slot antenna 209. The cavity 252 and the slot 221 together may be two radiating elements of the antenna to provide a determined transmission frequency for the antenna. The slot antenna 209 may be similar to the slot antenna 109, the cavity 252 may be similar to the cavity 152, and the slot 221 may be similar to the slot 121 of FIG. 1.

Since the cavity 252 is formed by the cutout 202 in the metal layer 253, the design of the cavity 252, e.g., the shape, size, and/or location of the cavity 252, may be determined by the cutout 202 to accommodate a package affixed to the PCB 201. For example, the cavity 252 may be of a shape of a triangular shape, a square, a rectangular shape, a circular shape, an elliptical shape, or a polygon comprising three or more sides. On the other hand, the slot 221 may be designed so that the slot 221 and the cavity 252 together may provide the transmission frequency for the antenna 209. For example, the slot 221 may include one or more rectangular segments, located around the cavity 252, as shown in FIG. 2.

In embodiments, the metal layer 253 may further include a slot 223. The slot 221 and the slot 223 may be of a similar shape, and may be disposed around a contour of the cavity 252. In such cases, the slot 221, the slot 223, and the cavity 252 may function together to provide a determined transmission frequency for the antenna 209.

In embodiments, the metal layer 253 may further include a portion of a transmission line 225 of the slot antenna 209. The portion of the transmission line 225 may be in contact with the cavity 252, the slot 221, and/or the slot 223. In embodiments, the portion of the transmission line 225 may be a portion of a microstrip, a stripline, or a coplanar waveguide transmission line.

In embodiments, the slot antenna 209 formed in the metal layer 253 may include the cavity 252, the slot 221, the slot 223, and the portion of the transmission line 225. The metal layer 253 may be a metal plate. When the metal layer 253 is driven as an antenna by a driving frequency, the one or more slots, e.g., the cavity 252, the slot 221, and/or the slot 223, may radiate electromagnetic waves in a way similar to a dipole antenna. The shape and size of the slots, as well as the driving frequency, may determine the radiation distribution pattern. In embodiments, the slot antenna 209 may be used at ultra high frequency (UHF) or microwave frequencies. For example, the slot antenna 209 may have a transmission frequency around 800 Mhz to around 10 Ghz. In embodiments, the slot antenna 209 may have advantages in size, design simplicity, robustness, and convenient adaptation to mass production, compared to other antennas. In addition, the slot antenna 209 utilizes the cavity 252 caused by the cutout 202, saving the cost of covering the cavity 252 to reduce unwanted electromagnetic interference.

Figure 3:
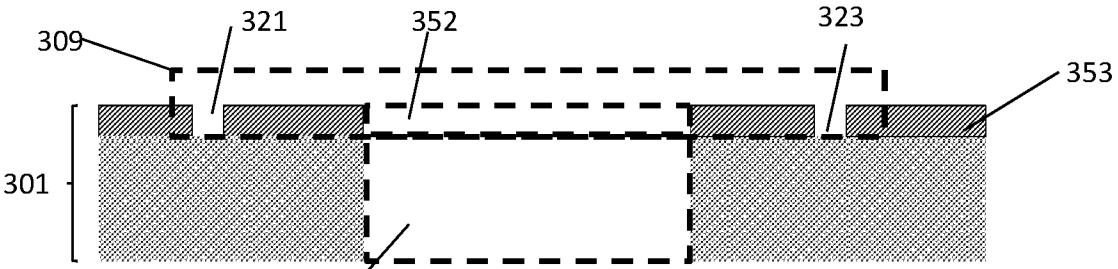
FIG. 3 illustrates a cross-section view of an example slot antenna formed in a metal layer of a PCB, according to various embodiments.

FIG. 3 illustrates a cross-section view of an example slot antenna 309 formed in a metal layer 353 of a PCB 301, according to various embodiments. In embodiments, the PCB 301 may be an example of the PCB 101 shown in FIG. 1, where the metal layer 353 may be an example of the metal layer 153, and the cutout 302 may be an example of the cutout 102. Furthermore, the PCB 301 may be similar to the PCB 201, the metal layer 353 may be similar to the metal layer 253, and the cutout 302 may be similar to the cutout 202, as shown in FIG. 2.

In embodiments, the PCB 301 may include a plurality of layers, such as a power layer, a signal layer, and the metal layer 353. The metal layer 353 may include a cavity 352 formed in the metal layer 353 by the cutout 302 of the PCB 301. In embodiments, the cutout 302 may cut through multiple layers of the PCB 301, and the cavity 352 of the metal layer may be formed by the cutout 302 in the metal layer 353. In some embodiments, the cutout 302 may be formed by extending the cavity 352 in the metal layer 353 through the multiple layers of the PCB 301. The cavity 352 may be a radiating element of the slot antenna 309 formed in the metal layer 353.

In addition, the metal layer 353 may include a slot 321 and/or a slot 323, where the slot 321 and/or the slot 323 may be additional radiating elements of the slot antenna 309. The cavity 352, the slot 321, and/or the slot 323 together may be radiating elements of the antenna 309 to provide a determined transmission frequency for the antenna 309. The slot 321 and the slot 323 may be of a similar shape, and may be disposed around a contour of the cavity 352.

In embodiments, the slot antenna 309 formed in the metal layer 353 may include the cavity 352, the slot 321, and/or the slot 323. When the metal layer 353 is driven as an antenna by a driving frequency, the one or more slots, e.g., the cavity 352, the slot 321, and/or the slot 323 may radiate electromagnetic waves in a way similar to a dipole antenna. The shape and size of the slots, as well as the driving frequency, may determine the radiation distribution pattern. In embodiments, the slot antenna 309 may have a transmission frequency around 800 Mhz to around 10 Ghz. In embodiments, the metal layer 353 may further include a portion of a transmission line of the slot antenna 309, not shown, where the transmission line may be a microstrip, a stripline, or a coplanar waveguide transmission line.

Figure 4:
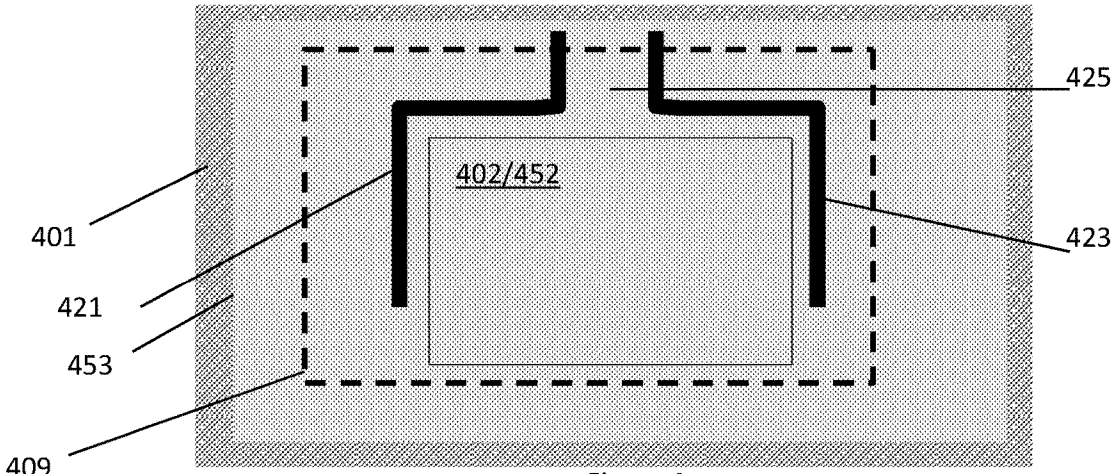
FIGS. 4-6 illustrate top views of further example slot antennas formed in a metal layer of a PCB, according to various embodiments.

FIG. 4 illustrates a top view of an example slot antenna 409 formed in a metal layer 453 of a PCB 401, according to various embodiments. In embodiments, the PCB 401 may be an example of the PCB 101, the metal layer 453 may be an example of the metal layer 153, and the cutout 402 may be an example of the cutout 102, as shown in FIG. 1. Furthermore, the PCB 401 may be similar to the PCB 201, the metal layer 453 may be similar to the metal layer 253, and the cutout 402 may be similar to the cutout 202, as shown in FIG. 2.

In embodiments, the PCB 401 may have a cutout 402. Furthermore, the metal layer 453 may include a cavity 452 formed in the metal layer 453 by the cutout 402. Seen from the top view, the cutout 402 and the cavity 452 in the metal layer 453 may look the same. The cavity 452 may be a first radiating element of the slot antenna 409. In addition, the metal layer 453 may also include a slot 421 and a slot 423, where the slot 421 and the slot 423 may be additional radiating elements of the slot antenna 409. The cavity 452, the slot 421, and/or the slot 423 together may be radiating elements of the antenna 409 to provide a determined transmission frequency for the antenna 409. The slot 421 and the slot 423 may be of a similar shape, and may be disposed around a contour of the cavity 452. In embodiments, the metal layer 453 may further include a portion of a transmission line 425, where the transmission line 425 may be a microstrip, a stripline, or a coplanar waveguide transmission line.

The cutout 402 may be of a square shape as shown in FIG. 4. The shape of the cutout 402 may be different from the shape of the cutout 202 in FIG. 2, where the cutout 202 may be a combination of two rectangles. The shape, size, and/or location of the cutout 402 may be determined by the package affixed to the PCB 401, and/or the components on the package, to accommodate the different heights of the components within the package.

Figure 5:
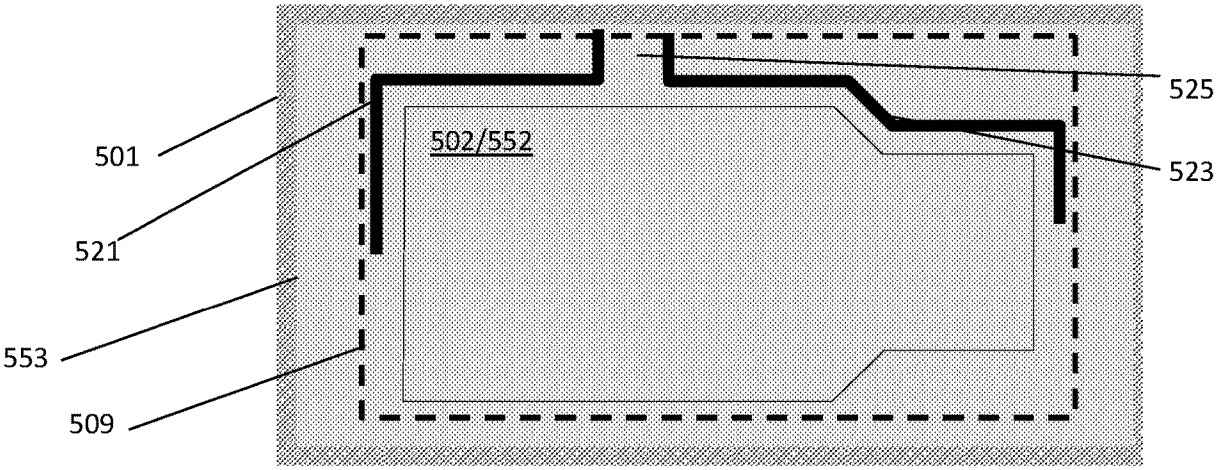

FIG. 5 illustrates a top view of an example slot antenna 509 formed in a metal layer 553 of a PCB 501, according to various embodiments. In embodiments, the PCB 501 may be an example of the PCB 101, the metal layer 553 may be an example of the metal layer 153, and the cutout 502 may be an example of the cutout 102, as shown in FIG. 1. Furthermore, the PCB 501 may be similar to the PCB 201, the metal layer 553 may be similar to the metal layer 253, and the cutout 502 may be similar to the cutout 202, as shown in FIG. 2.

In embodiments, the PCB 501 may have a cutout 502. Furthermore, the metal layer 553 may include a cavity 552 formed in the metal layer 553 by the cutout 502. As shown in top view, the cutout 502 and the cavity 552 of the metal layer 553 may look the same. The cavity 552 may be a first radiating element of the slot antenna 509. In addition, the metal layer 553 may also include a slot 521 and a slot 523, where the slot 521 and the slot 523 may be additional radiating elements of the slot antenna 509. The cavity 552, the slot 521, and/or the slot 523 together may be radiating elements of the antenna 509 to provide a determined transmission frequency for the antenna 509. The slot 521 and the slot 523 may be of a similar shape, and may be disposed around a contour of the cavity 552. In embodiments, the metal layer 553 may further include a portion of a transmission line 525, where the transmission line 525 may be a microstrip, a stripline, or a coplanar waveguide transmission line.

The cutout 502 may be of a polygon including three or more sides, e.g., eight sides. The shape of the cutout 502 may be different from the shape of the cutout 202 in FIG. 2, where the cutout 202 may be a combination of two rectangles. The shape of the cutout 502 may also be different from the shape of the cutout 402 in FIG. 4, where the cutout 402 may be a square. The shape, size, and/or location of the cutout 502 may be determined by the package affixed to the PCB 501, and/or the components within the package, to accommodate the different heights of the components on the package.

Figure 6:
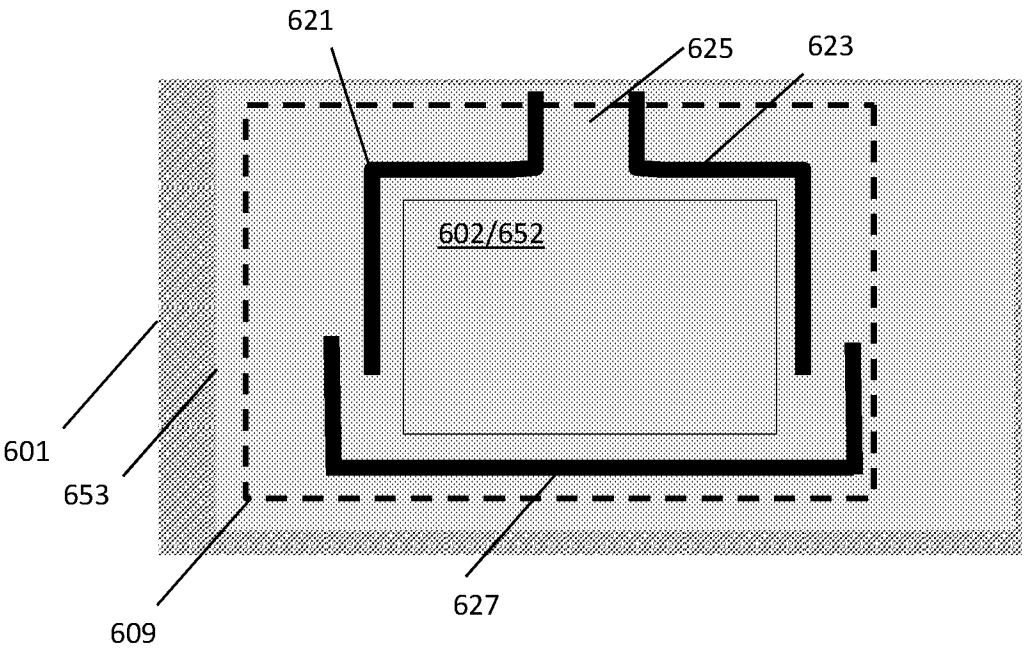

FIG. 6 illustrates a top view of an example slot antenna 609 formed in a metal layer 653 of a PCB 601, according to various embodiments. In embodiments, the PCB 601 may be an example of the PCB 101, the metal layer 653 may be an example of the metal layer 153, and the cutout 602 may be an example of the cutout 102, as shown in FIG. 1. Furthermore, the PCB 601 may be similar to the PCB 201, the metal layer 653 may be similar to the metal layer 253, and the cutout 602 may be similar to the cutout 202, as shown in FIG. 2.

In embodiments, the PCB 601 may have a cutout 602. Furthermore, the metal layer 653 may include a cavity 652 formed in the metal layer 653 by the cutout 602. As shown in top view, the cutout 602 and the cavity 652 of the metal layer 653 may look the same. The cavity 652 may be a first radiating element of the slot antenna 609. In addition, the metal layer 653 may also include a slot 621 and a slot 623, where the slot 621 and the slot 623 may be additional radiating elements of the slot antenna 609. The cavity 652, the slot 621, and/or the slot 623 together may be radiating elements of the antenna 609 to provide a determined transmission frequency for the antenna 609. The slot 621 and the slot 623 may be of a similar shape, and may be around a contour of the cavity 652. In embodiments, the metal layer 653 may further include a portion of a transmission line 625, where the transmission line 625 may be a microstrip, a stripline, or a coplanar waveguide transmission line.

Furthermore, the slot antenna 609 may include an additional slot 627. The slot 627 may be an additional radiating element of the slot antenna 609. The slot 627 may be located in a position not close to the slot 621 or the slot 623, and may be of a different shape from the slot 621 or the slot 623. The choice for the shape, size, and location of the slot 627 may be independent from the slot 621 or the slot 623. The slot 627 may be a radiating element for a different band of the slot antenna 609. Hence, with the cavity 652, the slot 621, the slot 623, and/or the slot 627, the slot antenna 609 may be a multi-band slot antenna.

Figure 9:
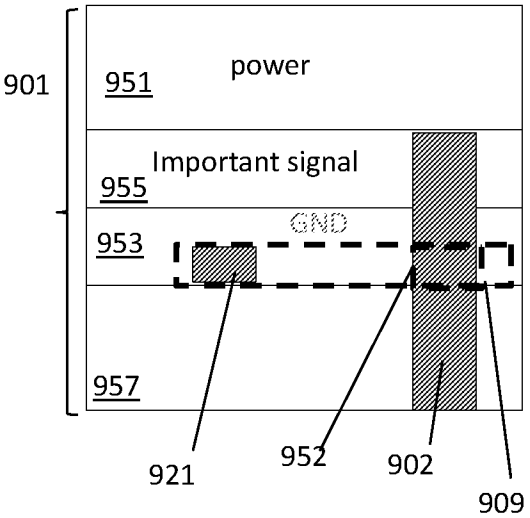
FIGS. 7-9 illustrate cross-section views of a metal layer of a PCB, where a slot antenna is formed in the metal layer, according to various embodiments.
Figure 8:
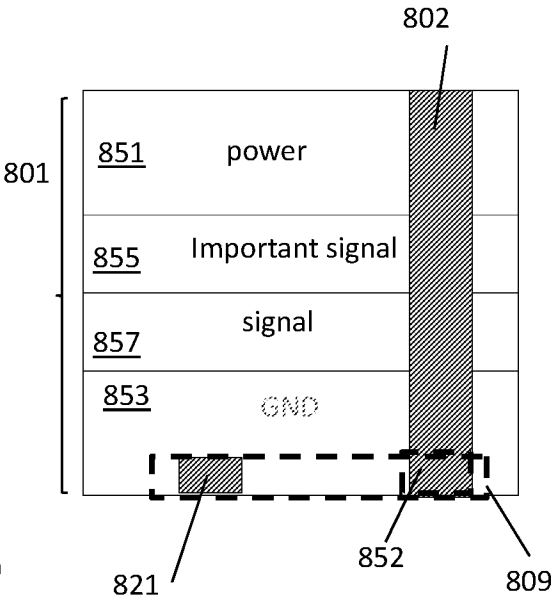
Figure 7:
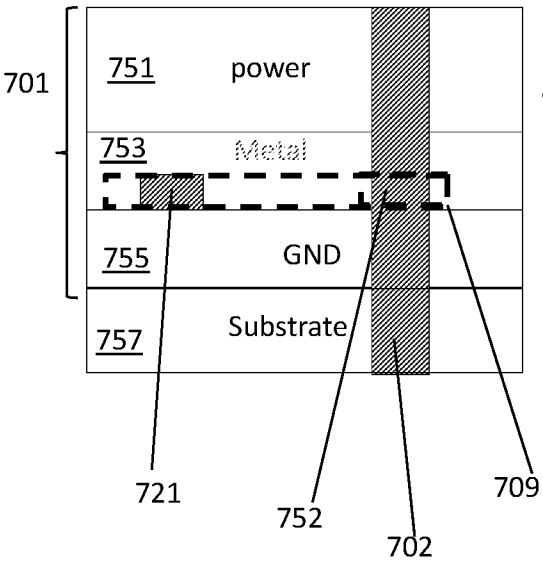

FIGS. 7-9 illustrate cross-section views of a metal layer of a PCB, where a slot antenna may be formed in the metal layer, according to various embodiments.

FIG. 7 illustrates a cross-section view of a metal layer 753 of a PCB 701, where a slot antenna 709 is formed in the metal layer 753, according to various embodiments. In embodiments, the PCB 701 may be an example of the PCB 101, the metal layer 753 may be an example of the metal layer 153, and the cutout 702 may be an example of the cutout 102, as shown in FIG. 1. Furthermore, the PCB 701 may be similar to the PCB 301, the metal layer 753 may be similar to the metal layer 353, and the cutout 702 may be similar to the cutout 302, as shown in FIG. 3.

In embodiments, the PCB 701 may include three layers formed on a substrate 757, e.g., a layer 751, which may be a power layer, the metal layer 753, and a layer 755, which may be a ground layer. The layer 751, the metal layer 753, and the layer 755 may be separated by dielectric layers, not shown. In embodiments, the dielectric layers separating the layer 751, the metal layer 753, and the layer 755 may be a woven glass reinforced layer, or a non-woven glass reinforced layer. The dielectric layers may include a material that may be a poor conductor of electricity, such as porcelain, mica, glass, plastics and some metal oxides. In embodiments, the ground layer, e.g., the layer 755, may be a bottom layer of the PCB 701 above the substrate 757, while the metal layer 753 may be different from the ground layer. The metal layer 753 may include a conductive metal or an alloy of metal, such as aluminum, copper, and/or steel alloy. The substrate 757 may include epoxy resin, woven glass fabric reinforcement, brominated flame retardant, or others.

The PCB 701 may include a cutout 702, which cuts through the layer 751, the metal layer 753, the layer 755, and the substrate 757. A cavity 752 may be formed in the metal layer 753 by the cutout 702. One or more slots may be formed in the metal layer 753 for the slot antenna 709. For example, the metal layer 753 may further include a slot 721. The slot antenna 709 may include the cavity 752 and the slot 721.

FIG. 8 illustrates a cross-section view of a metal layer 853 of a PCB 801, where a slot antenna 809 is formed in the metal layer 853, according to various embodiments. In embodiments, the PCB 801 may be an example of the PCB 101, the metal layer 853 may be an example of the metal layer 153, and the cutout 802 may be an example of the cutout 102, as shown in FIG. 1. Furthermore, the PCB 801 may be similar to the PCB 301, the metal layer 853 may be similar to the metal layer 353, and the cutout 802 may be similar to the cutout 302, as shown in FIG. 3.

In embodiments, the PCB 801 may include four layers, e.g., a layer 851, which may be a power layer, a layer 855, which may be a layer for a first set of signals, a layer 857, which may be a layer for a second set of signals, and the metal layer 853, which may be a ground layer. The four layers may be placed over a substrate, not shown. The layer 851, the metal layer 853, the layer 855, and the layer 857 may be separated by dielectric layers, not shown. In embodiments, the metal layer 853 may be the ground layer, and may be a bottom layer of the PCB 801. The metal layer 853 may include a conductive metal or an alloy of metal, such as aluminum, copper, and/or steel alloy.

The PCB 801 may include the cutout 802, which cuts through the layer 851, the metal layer 853, the layer 855, and the layer 857. A cavity 852 may be formed in the metal layer 853 by the cutout 802. In addition, the metal layer 853 may further include a slot 821. The slot antenna 809 may include the cavity 852, and the slot 821. One or more other slots may be further formed in the metal layer 853 for the slot antenna 809, not shown.

FIG. 9 illustrates a cross-section view of a metal layer 953 of a PCB 901, where a slot antenna 909 is formed in the metal layer 953, according to various embodiments. In embodiments, the PCB 901 may be an example of the PCB 101, the metal layer 953 may be an example of the metal layer 153, and the cutout 902 may be an example of the cutout 102, as shown in FIG. 1. Furthermore, the PCB 901 may be similar to the PCB 301, the metal layer 953 may be similar to the metal layer 353, and the cutout 902 may be similar to the cutout 302, as shown in FIG. 3.

In embodiments, the PCB 901 may include four layers, e.g., a layer 951, which may be a power layer, a layer 955, which may be a layer for a first set of signals, a layer 957, which may be a layer for a second set of signals, and the metal layer 953, which may be a ground layer. The layer 951, the metal layer 953, the layer 955, and the layer 957 may be separated by dielectric layers, not shown. In embodiments, the metal layer 953 may be the ground layer, and may be next to a bottom layer of the PCB 901. The metal layer 953 may include a conductive metal or an alloy of metal, such as aluminum, copper, and/or steel alloy.

The PCB 901 may include the cutout 902, which cuts through the metal layer 953, the layer 955, and the layer 957. In embodiments, the cutout 902 may not extend to cut through the layer 951, and the layer 951 may be intact. A cavity 952 may be formed in the metal layer 953 by the cutout 902. In addition, the metal layer 953 may further include a slot 921. The slot antenna 909 may include the cavity 952, and the slot 921. One or more other slots may be further formed in the metal layer 953 for the slot antenna 909, not shown.

Embodiments shown in FIGS. 7-9 may be for examples only and are not limiting. In embodiments, a PCB may include various numbers of layers. For example, a PCB may have six layers stacked up, including layers such as a first signal layer, a ground layer, a power layer, a mixed signal layer, a second ground layer, and a second signal layer. A cutout may be formed through all or a part of the layers of the PCB. A slot antenna may be formed in a metal layer, which may be a ground layer of the PCB, or a dedicated metal layer designed for forming the slot antenna. In some embodiments, a PCB may have twelve layers including a metal layer where a slot antenna may be formed.

Figure 10:
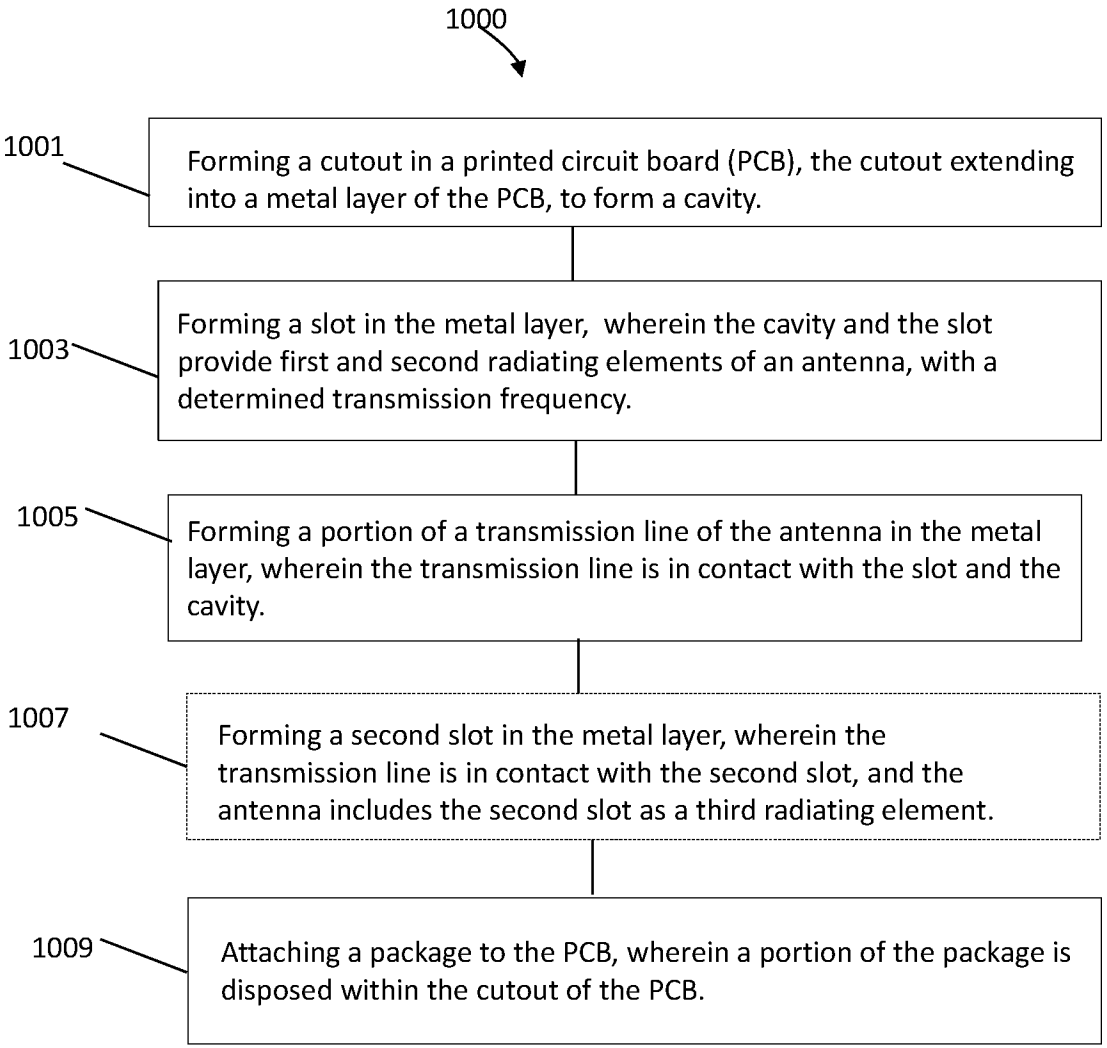
FIG. 10 illustrates a flow chart for a process of making a slot antenna in a metal layer of a PCB, according to various embodiments.

FIG. 10 illustrates a flow chart for an example process 1000 of making a slot antenna in a metal layer of a PCB, according to various embodiments. The process 1000 may be applied to form the slot antenna 109 in the metal layer 153 of the PCB 101 as shown in FIG. 1, or the slot antenna 209 in the metal layer 253 of the PCB 201 as shown in FIG. 2.

In block 1001, the process 1000 may include forming a cutout in a PCB, the cutout extending into a metal layer of the PCB, to form a cavity. For example, the process 1000 may include forming the cutout 102 in the PCB 101, where the cutout 102 may extend into the metal layer 153 of the PCB 101 to form the cavity 152 in the metal layer 153.

In block 1003, the process 1000 may include forming a slot in the metal layer, wherein the cavity and the slot may provide first and second radiating elements of an antenna, with a determined transmission frequency. For example, the process 1000 may include forming a slot 121 in the metal layer 153, wherein the cavity 152 and the slot 121 provide first and second radiating elements of the antenna 109, with a determined transmission frequency.

In block 1005, the process 1000 may include forming a portion of a transmission line of the antenna in the metal layer, wherein the transmission line is in contact with the cavity and the slot. For example, the process 1000 may include forming a portion of a transmission line 225 in the metal layer 253, wherein the transmission line 225 may be in contact with the cavity 252 and the slot 221, as shown in FIG. 2.

Optionally, in block 1007, the process 1000 may include forming a second slot in the metal layer, wherein the transmission line is in contact with the second slot, and the antenna includes the second slot as a third radiating element. For example, the process 1000 may include forming a slot 223 in the metal layer 253. The metal layer 253 may already have the cavity 252 and the slot 221, and a portion of the transmission line 225. The slot 223 may be formed as a second slot for the slot antenna 209, and the slot 223 may be in contact with the portion of the transmission line 225, as shown in FIG. 2. In embodiments, the second slot, e.g., the slot 223, and a slot, e.g., the slot 221, may be formed around a contour of the cavity, e.g., the cavity 252.

In block 1009, the process 1000 may include attaching a package to the PCB, wherein a portion of the package is disposed within the cutout of the PCB. For example, the process 1000 may include attaching the package 104 to the PCB 101, so that a portion of the package 104, e.g., the component 171, may be placed within the cutout 102.

Figure 11:
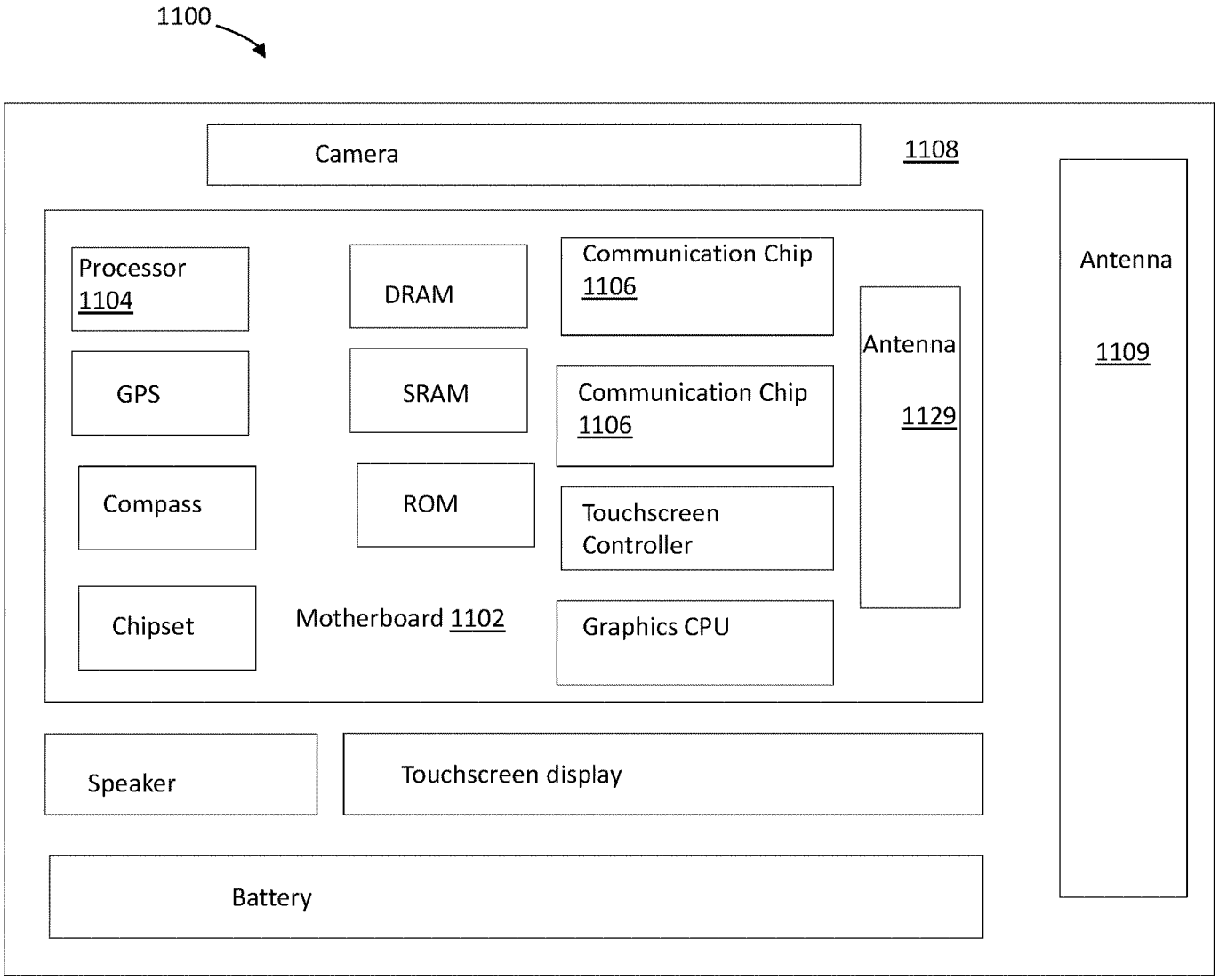
FIG. 11 illustrates an example computing device that may employ the apparatuses and/or methods described herein, according to various embodiments.

FIG. 11 illustrates an example computing device 1100 that may employ the apparatuses and/or methods described herein (e.g., the computing device 1100 assembled on a motherboard 1102 with IC packages), according to various embodiments.

Components of the computing device 1100 may be housed in an enclosure (e.g., housing 1108). The motherboard 1102 may include a number of components, including but not limited to a processor 1104 and at least one communication chip 1106. In embodiments, the motherboard 1102 may include an antenna 1129, which may be similar to the PCB 101 including the slot antenna 109, the PCB 201 including the slot antenna 209, the PCB 301 including the slot antenna 309, the PCB 401 including the slot antenna 409, the PCB 501 including the slot antenna 509, the PCB 601 including the slot antenna 609, the PCB 701 including the slot antenna 709, the PCB 801 including the slot antenna 809, and/or the PCB 901 including the slot antenna 909. The processor 1104 may be physically and electrically coupled to the motherboard 1102. In some implementations, the at least one communication chip 1106 may also be physically and electrically coupled to the motherboard 1102. In further implementations, the communication chip 1106 may be part of the processor 1104. In addition, the computing device 1100 may further include another antenna 1109 outside the motherboard 1102.

Depending on its applications, the computing device 1100 may include other components that may or may not be physically and electrically coupled to the motherboard 1102. These other components may include, but are not limited to, volatile memory (e.g., DRAM), static random access memory (SRAM), non-volatile memory (e.g., ROM), flash memory, a graphics central processing unit (CPU), a digital signal processor, a crypto processor, a chipset, a display, a touchscreen display, a touchscreen controller, a battery, an audio codec, a video codec, a power amplifier, a global positioning system (GPS) device, a compass, a Geiger counter, an accelerometer, a gyroscope, a speaker, a camera, and a mass storage device (such as hard disk drive, compact disk (CD), digital versatile disk (DVD), and so forth). These components may be included in IC packages, e.g., the IC package 104. The components, such as the processor 1104, the communication chip 1106, DRAM, SRAM, ROM, GPS, may have different heights.

The communication chip 1106 may enable wireless communications for the transfer of data to and from the computing device 1100. The term "wireless" and its derivatives may be used to describe circuits, devices, systems, methods, techniques, communications channels, etc., that may communicate data through the use of modulated electromagnetic radiation through a non-solid medium. The term does not imply that the associated devices do not contain any wires, although in some embodiments they might not. The communication chip 1106 may implement any of a number of wireless standards or protocols, including but not limited to Institute for Electrical and Electronic Engineers (IEEE) standards including Wi-Fi (IEEE 802.11 family), IEEE 802.16 standards (e.g., IEEE 802.16-2005 Amendment), Long-Term Evolution (LTE) project along with any amendments, updates, and/or revisions (e.g., advanced LTE project, ultra mobile broadband (UMB) project (also referred to as "3GPP2"), etc.). IEEE 802.16 compatible broadband wireless access (BWA) networks are generally referred to as WiMAX networks, an acronym that stands for Worldwide Interoperability for Microwave Access, which is a certification mark for products that pass conformity and interoperability tests for the IEEE 802.16 standards. The communication chip 1106 may operate in accordance with a Global System for Mobile Communication (GSM), General Packet Radio Service (GPRS), Universal Mobile Telecommunications System (UMTS), High Speed Packet Access (HSPA), Evolved HSPA (E-HSPA), or LTE network. The communication chip 1106 may operate in accordance with Enhanced Data for GSM Evolution (EDGE), GSM EDGE Radio Access Network (GERAN), Universal Terrestrial Radio Access Network (UTRAN), or Evolved UTRAN (E-UTRAN). The communication chip 1106 may operate in accordance with Code Division Multiple Access (CDMA), Time Division Multiple Access (TDMA), Digital Enhanced Cordless Telecommunications (DECT), Evolution-Data Optimized (EV-DO), derivatives thereof, as well as any other wireless protocols that are designated as 3G, 4G, 5G, and beyond. The communication chip 1106 may operate in accordance with other wireless protocols in other embodiments.

The computing device 1100 may include a plurality of communication chips 1106. For instance, a first communication chip 1106 may be dedicated to shorter range wireless communications such as Wi-Fi and Bluetooth and a second communication chip 1106 may be dedicated to longer range wireless communications such as GPS, EDGE, GPRS, CDMA, WiMAX, LTE, EV-DO, and others.

In various implementations, the computing device 1100 may be a mobile computing device, a laptop, a netbook, a notebook, an ultrabook, a smartphone, a tablet, a personal digital assistant (PDA), an ultra mobile PC, a mobile phone, a desktop computer, a server, a printer, a scanner, a monitor, a set-top box, an entertainment control unit, a digital camera, a portable music player, or a digital video recorder. In further implementations, the computing device 1100 may be any other electronic device that processes data.

Thus various example embodiments of the present disclosure have been described including, but are not limited to:

Example 1 may include an electronic apparatus, comprising: a printed circuit board (PCB), wherein the PCB has a plurality of layers including a metal layer, wherein the PCB includes a cutout through the plurality of layers, to form a cavity in the metal layer, wherein the metal layer includes a slot, wherein the cavity comprises a first radiating element of an antenna, and the slot comprises a second radiating element of the antenna, and wherein the first and second radiating elements provide a determined transmission frequency for the antenna.

Example 2 may include the electronic apparatus of example 1 and/or some other examples herein, wherein the metal layer further includes a portion of a transmission line of the antenna, and the transmission line is in contact with the cavity and the slot.

Example 3 may include the electronic apparatus of example 2 and/or some other examples herein, wherein the transmission line is a microstrip, a stripline, or a coplanar waveguide transmission line.

Example 4 may include the electronic apparatus of example 2 and/or some other examples herein, wherein the metal layer further includes: a second slot in the metal layer, wherein the transmission line is in contact with the second slot, and the antenna includes the second slot as a third radiating element.

Example 5 may include the electronic apparatus of example 4 and/or some other examples herein, wherein the slot and the second slot are of a similar shape, and are disposed around a contour of the cavity.

Example 6 may include the electronic apparatus of example 1 and/or some other examples herein, wherein the metal layer is a ground layer of the PCB.

Example 7 may include the electronic apparatus of example 1 and/or some other examples herein, wherein the metal layer is a ground layer of the PCB, and comprises a bottom layer of the PCB, or next to the bottom layer of the PCB.

Example 8 may include the electronic apparatus of any of examples 1-7 and/or some other examples herein, further comprising: a package affixed to the PCB, wherein a portion of the package is disposed within the cutout of the PCB.

Example 9 may include the electronic apparatus of example 8 and/or some other examples herein, wherein the package comprises one of: a chip scale package (CSP), a wafer-level package (WLP), a quad-flat no-leads (QFN) package, a dual-flat no-leads (DFN) package, or a package with overmold mounted on the PCB.

Example 10 may include the electronic apparatus of any of examples 1-7 and/or some other examples herein, wherein the plurality of layers of the PCB include at least two of: the metal layer, a ground layer, a power layer, or a signal layer.

Example 11 may include the electronic apparatus of any of examples 1-7 and/or some other examples herein, wherein the determined transmission frequency of the antenna is around 800 Mhz to around 10 Ghz.

Example 12 may include the electronic apparatus of any of examples 1-7 and/or some other examples herein, wherein the cavity is of a shape of a triangular shape, a square, a rectangular shape, a circular shape, an elliptical shape, or a polygon comprising three or more sides.

Example 13 may include the electronic apparatus of any of examples 1-7 and/or some other examples herein, wherein the apparatus comprises a computing device.

Example 14 may include a printed circuit board (PCB), comprising: a substrate; and a metal layer on the substrate, wherein the metal layer includes: a cavity in the metal layer, wherein the cavity extends to be a cutout of the PCB which is through the substrate, and the cavity is a first radiating element of an antenna; and a slot in the metal layer, wherein the slot is a second radiating element of the antenna.

Example 15 may include the PCB of example 14 and/or some other examples herein, wherein the metal layer further includes a portion of a transmission line of the antenna, and the transmission line is in contact with the cavity and the slot.

Example 16 may include the PCB of example 15 and/or some other examples herein, wherein the transmission line is a microstrip, a stripline, or a coplanar waveguide transmission line.

Example 17 may include the PCB of example 15 and/or some other examples herein, wherein the metal layer further includes: a second slot in the metal layer, wherein the transmission line is in contact with the second slot, and the second slot is a third radiating element of the antenna.

Example 18 may include the PCB of example 17 and/or some other examples herein, wherein the slot and the second slot are of a similar shape, and are disposed around a contour of the cavity.

Example 19 may include the PCB of any of examples 14-18 and/or some other examples herein, wherein the metal layer is a ground layer of the PCB.

Example 20 may include the PCB of any of examples 14-18 and/or some other examples herein, further comprising: a ground layer, wherein the metal layer is different from the ground layer.

Example 21 may include a method for making a printed circuit board (PCB), comprising: forming a cutout in a printed circuit board (PCB), the cutout extending into a metal layer of the PCB, to form a cavity in the metal layer; and forming a slot in the metal layer, wherein the cavity and the slot provide first and second radiating elements of an antenna with a determined transmission frequency.

Example 22 may include the method of example 21 and/or some other examples herein, further comprising: forming a portion of a transmission line of the antenna in the metal layer, wherein the transmission line is in contact with the cavity and the slot.

Example 23 may include the method of any of examples 21-22 and/or some other examples herein, further comprising: forming a second slot in the metal layer, wherein the transmission line is in contact with the second slot, and the antenna includes the second slot as a third radiating element.

Example 24 may include the method of any of examples 21-22 and/or some other examples herein, wherein the slot and the second slot are formed around a contour of the cavity.

Example 25 may include the method of any of examples 21-22 and/or some other examples herein, further comprising: attaching a package to the PCB, wherein a portion of the package is disposed within the cutout of the PCB.

It will be apparent to those skilled in the art that various modifications and variations can be made in the disclosed embodiments of the disclosed device and associated methods without departing from the spirit or scope of the disclosure. Thus, it is intended that the present disclosure covers the modifications and variations of the embodiments disclosed above provided that the modifications and variations come within the scope of any claims and their equivalents.

What is claimed is:

1. A method for making a printed circuit board (PCB), comprising:

forming a cutout in the PCB, the cutout extending into a metal layer of the PCB, to form a cavity in the metal layer;

forming a first slot in the metal layer, including disposing the first slot partially around a contour of the cavity;

forming a second slot in the metal layer, including disposing the second slot partially around the contour of the cavity, to complement the disposal of the first slot around the contour of the cavity; and forming a transmission line in the metal layer, to provide electrical contact with the cavity and the first and second slots disposed around the contour of the cavity, wherein at least a portion of the transmission line, the cavity, and the first and second slots, formed in the metal layer, form an antenna, wherein the first and second slots and the cavity provide a determined transmission frequency for the antenna.

2. The method of claim 1, wherein the transmission line is in contact with the second slot, and the antenna includes the second slot as a radiating element.

3. The method of claim 1, wherein the first slot and the second slot are formed around the contour of the cavity.

4. The method of claim 1, further comprising:

attaching a package to the PCB, wherein a portion of the package is disposed within the cutout of the PCB.

* * * * *